United States Patent [19]

Oeck

[11] 4,412,889

[45] Nov. 1, 1983

[54] PYROLYSIS REACTION APPARATUS

[75] Inventor: Robert C. Oeck, Portland, Oreg.

[73] Assignee: Kleenair Products Co., Inc., Clackamas, Oreg.

[21] Appl. No.: 360,574

[22] Filed: Mar. 22, 1982

[51] Int. Cl.[3] ..... C10B 1/06; C10B 43/06; C10B 43/14

[52] U.S. Cl. ..... 202/117; 202/118; 202/241; 202/243; 202/265

[58] Field of Search ..... 202/117, 118, 217, 241, 202/243, 260, 265; 201/2, 25, 33

[56] References Cited

U.S. PATENT DOCUMENTS

| | | | |
|---|---|---|---|
| 1,211,805 | 1/1917 | Wright | 202/241 |
| 1,371,160 | 3/1921 | Ginet | 201/33 |
| 1,413,801 | 4/1922 | Smith | 202/118 |
| 1,457,083 | 5/1923 | McIntire | 202/118 |
| 1,461,614 | 7/1923 | Harrison . | |
| 1,972,929 | 9/1934 | Fisher | 202/118 |
| 2,265,158 | 12/1941 | Goodell | 201/33 |
| 2,983,653 | 5/1961 | Danulat et al. | 202/118 |
| 4,062,304 | 12/1977 | Herbold et al. | 202/118 |
| 4,094,769 | 6/1978 | Brown | 202/118 |
| 4,123,332 | 10/1978 | Rotter | 201/15 |
| 4,217,175 | 8/1980 | Reilly | 202/117 |
| 4,235,676 | 11/1980 | Chambers | 202/118 |
| 4,309,270 | 1/1982 | Tyler et al. | 201/2.5 |

*Primary Examiner*—Bradley Garris

*Attorney, Agent, or Firm*—Klarquist, Sparkman, Campbell, Leigh & Whinston

[57] ABSTRACT

Pyrolysis reaction apparatus and method are described in which carbonizable waste material is fed into the pyrolysis reaction chamber by an inlet conduit which passes through the wall of a heating furnace surrounding such chamber. As a result, the material is immediately vaporized in the reaction chamber due to the high temperature at the inlet portion of the chamber where the material is introduced. A fluid cooling jacket surrounds the inlet conduit to maintain the temperature within such conduit below the melting temperature of the material being transmitted therethrough in order to prevent clogging of the conduit. The material is fed into the reaction chamber by the inlet conduit along an input feed direction which is laterally offset from the axis of the shaft of an impeller for conveying such material through such chamber and is preferably directed toward the tips of the impeller blades in order to prevent clogging of the impeller. The treated material which may contain precious metal, such as the silver in photographic film, is heated within the reaction chamber in the absence of oxygen to decompose such material by chemical reaction into a hydrocarbon pyrolysis gas and a solid carbonized residue. The carbonized residue material of reduced size and weight may be further processed such as by oxidation to remove the carbon and convert the silver or other precious metal in such residue into a metal oxide which is refined to recover the metal.

10 Claims, 4 Drawing Figures

PYROLYSIS REACTION APPARATUS

BACKGROUND OF INVENTION

The subject matter of the present innvention relates generally to pyrolysis reaction apparatus and methods in which carbonizable waste material is heated in a reaction chamber in the absence of oxygen to decompose the material by pyrolytic reaction and produce hydrocarbon gas, liquid and solid residue. Such pyrolysis apparatus and method are particularly adapted for the treatment of material containing precious metal, such as photographic film, to recover silver or other precious metal without undue loss of the metal while operating in an efficient, inexpensive and trouble-free manner without polluting the environment.

With the pyrolysis apparatus and method of the present invention the carbonizable material is fed into the reaction chamber through a water cooled inlet conduit which passes through the wall of the furnace surrounding such reaction chamber. As a result of feeding it into a high temperature inlet portion of the reaction chamber, the material is immediately heated above its vaporization temperature in the reactor chamber. By cooling the inlet conduit with a cooling fluid jacket, such material is maintained below its melting temperature in the inlet conduit to prevent clogging of such conduit. The material is fed into the reaction chamber along an input feed path which is laterally offset from the axis of rotation of a auger type impeller means conveying the material within such chamber and is directed toward the tips of the impeller blades in order to prevent clogging of the impeller.

The pyrolysis reaction apparatus and method of the present invention is especially useful in the recovery of silver from the silver halide in photographic film including used X-ray film, without undue loss of the silver such as in conbustion vapor. The film is comminuted into film particles that are fed into the pyrolysis reaction chamber where they are vaporized to produce a combustible hydrocarbon pyrolysis gas and a solid carbonized residue containing silver which are both discharged from the reaction chamber through separate outlets. The pyrolysis gas may be fed to a burner within the furnace for combustion to heat the reaction chamber. The solid residue is reduced in size and weight by a factor of about 10 to 1 compared to the input material. Such residue is oxidized to remove the carbon and to produce silver oxide which is refined to recover the silver.

The present pyrolysis method of recovering silver from photographic film has many advantages over previous recovery methods. The most common recovery method is to burn the film in air which looses up to 40% of the silver in combustion vapor as well as creating an air pollution problem. Another method involves chemical treatment of the film for removing the silver by chemical reaction without burning so that the higher percentage of silver is recovered without an air pollution problem. However, such chemical treatment is extremely expensive and therefore impractical. These problems are avoided by using a pyrolysis process to recover silver from photographic film, but previous attempts to use pyrolysis were not successful because of clogging problems. Thus, clogging of carbonizable deposits were formed on the reaction chamber impeller, the inlet conduit and the outlet conduit of such reaction chamber because the film particles were fed along an inlet path toward the impeller axis and the film first melted in the reaction chamber before vaporizing. Such clogging also caused air to be sucked into the reaction chamber and such conduits causing explosions.

The pyrolysis apparatus and method of the present invention is an improvement over such prior pyrolysis apparatus and methods because with such invention the material to be treated is fed into the reation chamber by an inlet conduit which extends through the furnace wall and enters such chamber at an inlet region of high temperature for immediate vaporization of such material. In order to prevent melting of the material within the inlet conduit in the present invention, such conduit is surrounded with a fluid cooling jacket which maintains the temperature within the inlet conduit below the melting temperature of such material. In such prior pyrolysis apparatus and methods and those of U.S. Pat. No. 4,123,332 of rotter issued Oct. 31, 1978, U.S. Pat. No. 1,972,929 of Fisher issued Sept. 11, 1934 and U.S. Pat. No. 1,461,614 of Harrison issued July 10, 1923, the material to be treated is fed into the reaction chamber through an inlet conduit entering such chamber outside of the furnace. As a result the material enters a relatively cold inlet region of the reaction chamber where the material does not immediately vaporize, but first melts so that it clogs the inlet conduit as well as the auger impeller means used to convey the material through the reactor chamber. This clogging problem can be extremely dangerous because it can cause air to be sucked into the reaction chamber and conduits which may cause an explosion if the reaction chamber and inlet and outlet conduits are not cleaned frequently on a regular basis. Such regular cleaning necessitates shutting down of the pyrolysis apparatus and removal of the clogging deposit is difficult and time consuming so that the apparatus is very expensive to operate. Cooling of the impeller means within the reaction chamber by transmitting cooling fluid through the hollow impeller shaft in order to prevent melting of the impeller blades or deflection of the impeller shaft is shown in the above cited references as well as in the coal gasification apparatus of U.S. Pat. No. 2,983,653 of Danualt et al. issued May 9, 1961. However, this may be undesirable because too much cooling of the impeller can cause clogging deposits to condense on the impeller shaft and blades. This latter patent does not employ a furnace but the coal or other material to be treated is mixed with solid particles of heat carrier material such as sand or coke which is injected into the mixing chamber for heating such material. Also the mixing chamber of Danualt is not sealed to prevent the entry of oxygen containing gas so that it is not a pyrolysis reaction chamber. Previously pyrolysis reaction apparatus and methods have been used to convert organic waste into fuel including hydrocarbon gas which have been used to fuel a burner used in the furnace surrounding the reaction chamber as discussed in U.S. Pat. No. 4,123,332 of Rotter and in U.S. Pat. No. 4,235,676 of Chambers issued Nov. 25, 1982. However, none of these patents show the above-discussed deficiencies of the earlier discussed references.

SUMMARY OF INVENTION

It is one object of the present invention to provide an improved pyrolysis reaction apparatus and method of efficient, reliable and trouble-free operation in which clogging of the apparatus is prevented by immediate vaporization of the treated material in the reaction chamber.

Another object of the invention is to provide such a pyrolysis reaction apparatus and method in which the material being treated is fed into the reaction chamber at an inlet region of high temperature greater than the vaporization temperature of such material by means of a inlet conduit which extends into the chamber through the wall of a heating furnace surrounding the reaction chamber.

Still another object is to provide such a pyrolysis apparatus and method in which the inlet conduit is cooled by cooling fluid so that the temperture within such inlet conduit is maintained below the melting temperture of such material to prevent clogging of such conduit.

A further object of the present invention is to provide such a pyrolysis reaction apparatus and method in which the material being treated is fed into the reaction chamber along an input feed path which is laterally spaced from the axis of rotation of an impeller provided within such reaction chamber for conveying the treated material through the reaction chamber, to prevent clogging of the impeller.

An additional object of the invention is to provide such an improved pyrolysis apparatus and method of efficient trouble-free operation in which the inlet conduit to the reaction chamber is automatically reamed out during operation of the reaction chamber to prevent clogging.

A still further object of the present invention is to provide pyrolysis method of recovering precious metal from carbonizable material without undue loss of such metal, in an efficient, inexpensive annd trouble-free manner not causing significant pollution of the environment.

A still additional object is to provide such a pyrolysis method in which silver is recovered from photographic film by heating film particles above its vaporization temperature within a reaction chamber in the absence of oxygen to form a solid carbonized residue of reduced size and weight containing the silver which is discharged from such chamber and then oxidized to produce silver oxide that is subsequently refined to recover the silver.

DESCRIPTION OF DRAWINGS

Other objects and advantages of the present invention will be apparent from the following detailed description of preferred embodiments thereof and from the attached drawings of which.

DESCRIPTION OF PREFERRED EMBODIMENTS

Figure 1:
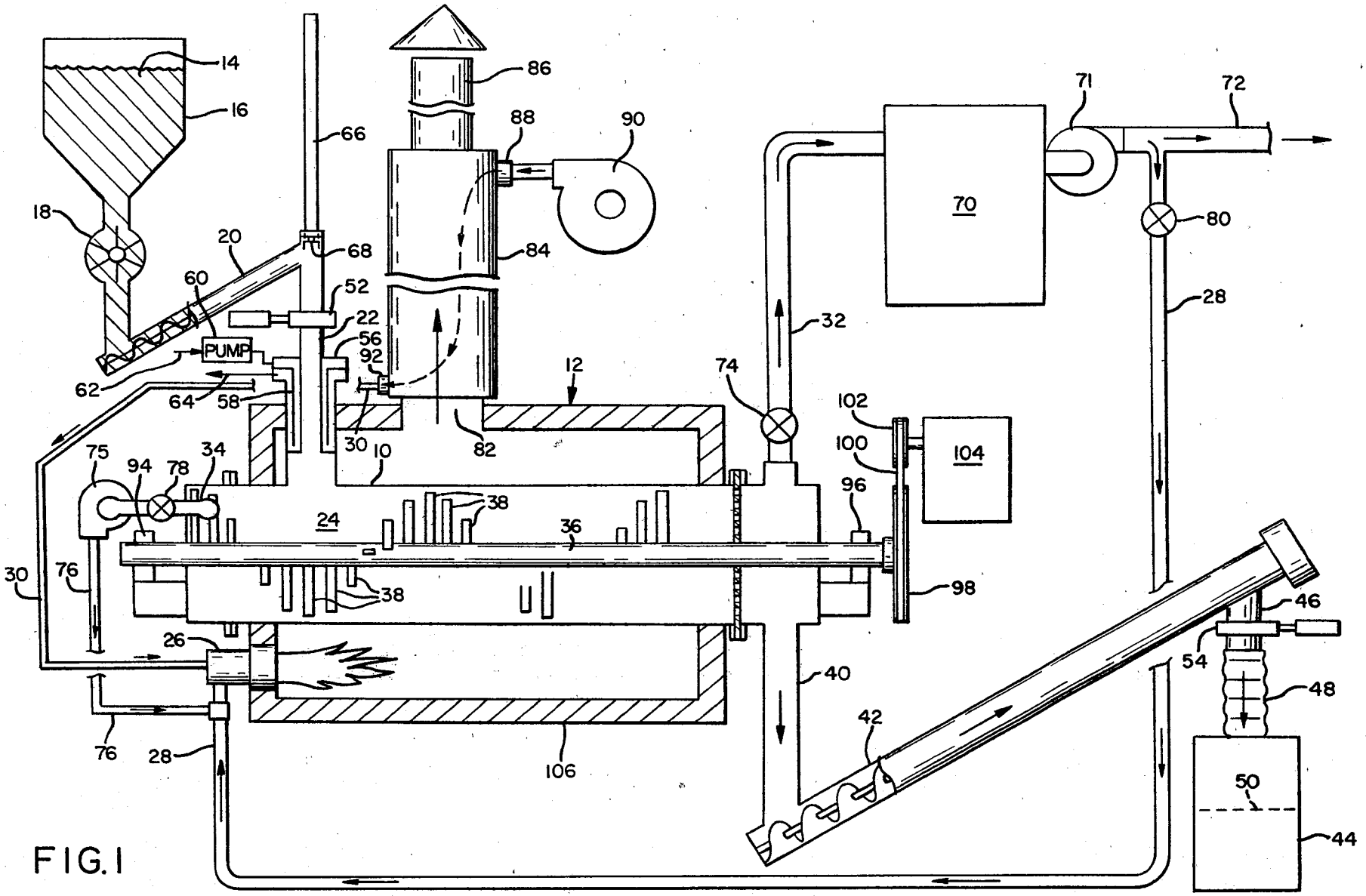
FIG. 1 is a schematic drawing of a pyrolysis reaction apparatus in accordance with the present invention and a system for carrying out a method of pyrolysis of carbonizable material in accordance with the invention.

One embodiment of the pyrolysis reaction apparatus of the present invention is used in the system shown in FIG. 1. The pyrolysis method of the present invention is practiced by such system. The pyrolysis apparatus includes a pyrolysis reaction chamber 10 in the form of a circular cylinder of high temperature metal alloy such as type RA 330 stainless steel. Reaction chamber 10 is surrounded by a heating furnace 12 for heating the reaction chamber above the vaporization temperature of the material to be treated. The material to be treated is a carbonizable material such as used photographic film, including X-ray film, which has been comminuted into film particles 14 about ⅜" long or less which are stored in a feed bin 16. The film particles or other carbonizable material 14 are fed through a rotary feed valve air lock 18 down into an infeed conveyor 20 of the screw type. The infeed conveyor 20 conveys the carbonizable material up into the top end of a substantially vertical inlet conduit 22 whose lower end extends through the furnace wall into the reaction chamber 10 at an inlet region 24 within such reaction chamber. The temperature of the inlet region 24 and the remainder of the reaction chamber is above the vaporization temperature of the carbonizable material being treated. The rotary air lock 18 and the carbonizable material 14 packed between such air lock and the infeed conveyor 20 form an airtight seal which prevents air from entering the reaction chamber 10 through the inlet conduit 22 while carbonizable material is fed through such conduit.

A gas burner 26 is mounted on the left end of the furnace 12 beneath the inlet end of the reaction chamber 10 so that inlet conduit 22 is separated from such burner by such reaction chamber. The burner 22 is started with natural gas or other commercial fuel and later supplied with pyrolysis gas from the reaction chamber through gas line 28 once the pyrolysis reaction begins. Heated air is supplied through air line 30 to the burner 26 for combustion of the fuel gas within the furnace 12 to heat the reaction chamber. The reaction chamber is heated above the vaporization temperature of the material being treated which is about 750° F. to 780° F. for photographic film particles. Typically the reaction chamber is heated to a temperature of about 1400° F., much higher than the vaporization temperature in order to speed the pyrolysis process. The pyrolysis process causes pyrolytic decomposition of the carbonizable material being heated in the absence of oxygen thereby preventing combustion of such material. As a result of the pyrolysis reaction, the carbonizable material decomposes into hydrocarbon gas, liquid and solid residue. The pyrolysis gas and liquid carried as a vapor by such gas, are conveyed out of the reaction chamber through a first gas outlet conduit 32 at the output end of such chamber or through a second gas outlet conduit 34 at the inlet end of such reaction chamber.

The reaction chamber 10 contains an impeller means, including a rotating impeller shaft 36 and a plurality of impeller blades 38 attached to such shaft. The impeller means provides an auger-type conveyor for conveying the solid carbonized residue produced by pyrolysis through the reaction chamber to a discharge conduit 40 adjacent the output end thereof. Any film particles or other carbonizable material which is not immediately vaporized, is also conveyed by such impeller means until such material is vaporized and converted into such residue. The solid carbonized residue is discharged through outlet conduit 40 into an outfeed screw conveyor 42 similar to infeed conveyor 20, which conveys such residue to a raised position above a sealed accumulator container 44. The residue is discharged from the conveyor 42 through an outlet pipe 46 into the accumulator container 44 which stores such residue in a residue pile 50 until the container is filled at which time it is disconnected and emptied before reconnection. The outlet pipe 46 is connected by a flexible metal coupling 48 to the accumulator container to provide a sealed airtight outlet system which prevents air from entering the reaction chamber 10 through the residue discharge conduit 40. Hydraulically operated blast gates 52 and 54 are provided in the inlet conduit 22 and the residue conveyor pipe 46, respectively, to close such conduits in the event of an an input feeding problem and to enable emptying of accumulator 44.

The accumulator container 44 contains solid carbonized residue 50 which includes silver when the material being treated is photographic film particles. The solid residue 50 is reduced in size and weight by a factor of approximately 10 to 1 compared to the size and weight of the carbonizable material fed through inlet conduit 22 into the reaction chamber. This reduction in size and weight greatly reduces the cost of further processing to recover the silver. The carbonized residue 50 is further treated, by oxidation in an oxidation reduction furnace to remove the carbon material and to convert the silver into a silver oxide material of even smaller size and weight than the residue 50. The silver oxide material is then refined to recover elemental silver in a conventional manner.

A cooling jacket 56 of stainless steel is provided around the lower end of the inlet conduit 22 and water or other cooling fluid is fed through such jacket to cool the inlet conduit and thereby maintain the carbonizable material within such conduit below its melting temperature which is about 660° F. for photographic film, to prevent clogging of the inlet conduit. The cooling jacket includes an internal sleeve 58 which divides the jacket into an inner chamber and an outer chamber. The inner chamber adjacent the inlet conduit 22 is connected through a pump 60 to a water pipe 62 for supplying cold water into such inner chamber. The outer chamber adjacent the jacket housing is connected to a water discharge outlet 64 through which the water is discharged after cooling. In this manner, the temperature within the inlet conduit 22 is kept below about 200° F. and melting of the photographic film is prevented. Otherwise the film would melt and deposit on the surface of the inlet conduit to cause clogging. In the unlikely event of clogging of the inlet conduit, an automatic reamer means is provided including a hydraulically operated cylinder 66 whose piston moves in alignment with the axis of the inlet conduit 22 for reaming such conduit. A cup-shaped reaming member 68 is attached to the piston rod within cylinder 66 and has a outer diameter slightly less than the inner diameter of inlet conduit 22 to remove any deposits on inner surface of such conduit. The impeller blades 38 are attached to the impeller shaft 36 in groups of aligned blades, such groups being circumferentially spaced apart about the axis of the shaft 36 so that another reamer may be inserted manually between the groups of blades for cleaning the impeller by extending through an opening (not shown) in the left end of the reaction chamber 10.

As shown in FIG. 1 the first gas outlet conduit 32 is connected to a pyrolysis gas and liquid recovery system 70 which may include water-spray means for condensing vapor in the gas and causing it to deposit as a liquid such as oil in a settling pool. The recovery system 70 may also include gas filters and cyclone separators for separating any solid particles from the pyrolysis gas which is then transmitted through a fan 71 to a gas outlet pipe 72 connected to a pyrolysis gas storage tank (not shown). A portion of the pyrolysis gas may be fed from fan 71 through the gas line 28 to the burner 26 for burning such pyrolysis gas in the furnace to heat the reaction chamber. The burner 26 is connected to a source of natural gas temporarily during the start-up of the pyrolysis reaction chamber until sufficient pyrolysis gas is generated to operate the burner. A shut-off valve 74 may be provided in the first gas outlet conduit 32 in order to shut off such conduit when it is desirable to cause all of the pyrolysis gas to be discharged from the reaction chamber 10 through the second gas outlet conduit 34 at the input end of the reaction chamber. This is done when burning all the pyrolysis gas produced during recovery of silver from photographic film particles, since the amount of pyrolysis gas generated thereby is only sufficient to fuel the burner 26.

The second gas outlet conduit 34 is connected through a fan 75 and a second gas line 76 to the gas inlet of burner 26 for supplying pyrolysis gas to such burner. This has the advantage that less condensation of the vapors in the pyrolysis gas takes place in the gas outlet conduit 34 and gas line 76, so that such vapor along with the pyrolysis gas is burned by burner 26. A shut-off valve 78 is provided in the second gas outlet conduit 34 in order to close such conduit when the shut-off valve 74 in the first gas outlet conduit 32 is open. Of course, the shut-off valve 78 may be left partially open while valve 74 is also left open so that a portion of the pyrolysis gas is transmitted directly through line 76 to the burner while the rest is transmitted through the first conduit 32 and the gas liquid recovery system 70 to the outlet pipe 72. In this case, a third shut-off valve 80 is provided in the gas line 28 to close such line since it is not needed to feed the burner.

The combustion gases produced by the burner 26 flow within the furnace 12 in the direction as the carbonized material is conveyed in the reaction chamber 10 and are transmitted out of the top of such furnace through an exhaust conduit 82 which is connected to the lower end of a heat exchanger 84 of the counterflow type. The combustion gases are transmitted out of the top of the heat exchanger through an exhaust stack 86 to the atmosphere. A cooling fluid inlet 88 on the heat exchanger is connected to the outlet of a fan 90 which blows air at atmospheric temperature through the heat exchanger in the opposite direction of flow of the exhaust gas. As a result such air is heated and the heated air is transmitted from a cooling fluid outlet 92 at the bottom of the heat exchanger into an air conduit 30 which conveys the heated air into the burner 26 for combustion of the pyrolysis gas and more efficient heating of the furnace.

The impeller shaft 36 is mounted for rotation at its opposite ends on bearings 94 and 96. One end of the impeller shaft 36 is connected to a large diameter gear 98 which rotates such shaft. The gear 98 is connected by a coupling chain 100 to a smaller diameter gear 102 attached to the output shaft of a drive motor 104 which may be any suitable electrical motor whose speed may be adjusted.

Figure 2:
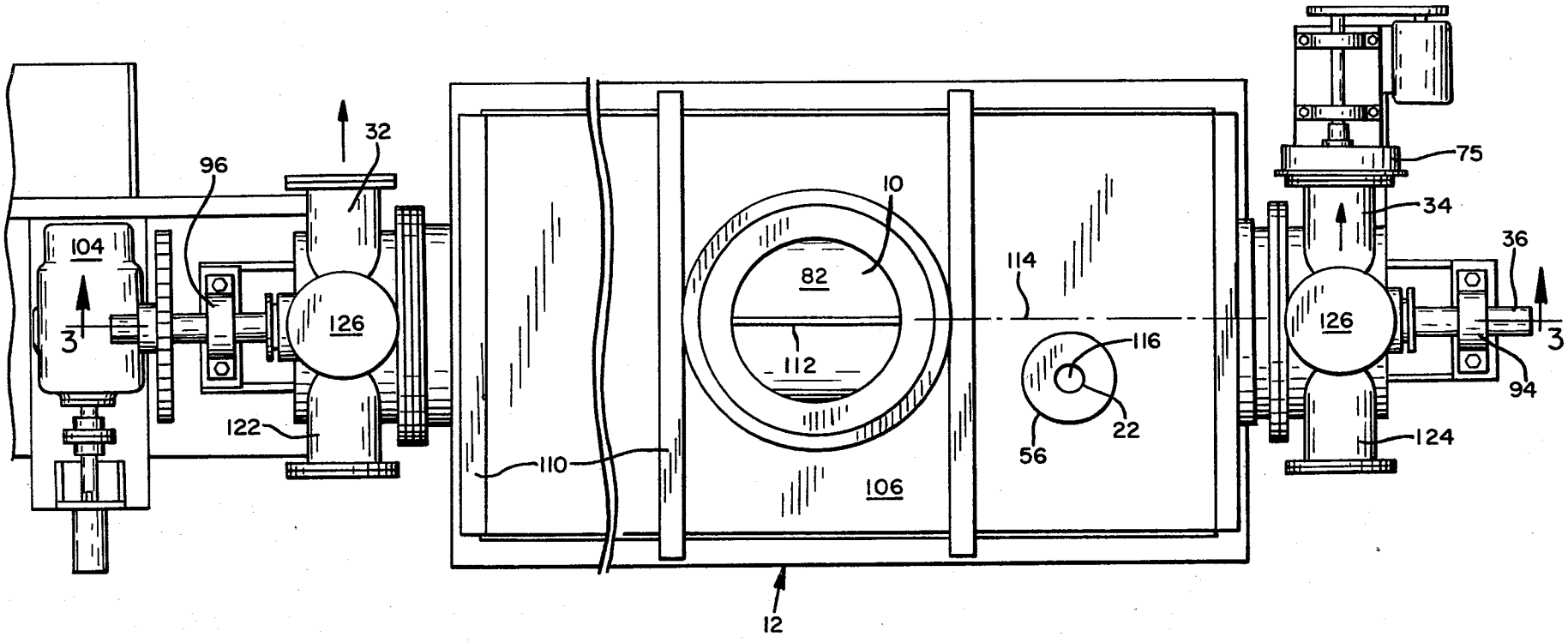
FIG. 2 is a plan view of the top of a portion of the pyrolysis reaction apparatus of FIG. 1 including the furnace and reaction chamber contained therein.
Figure 3:
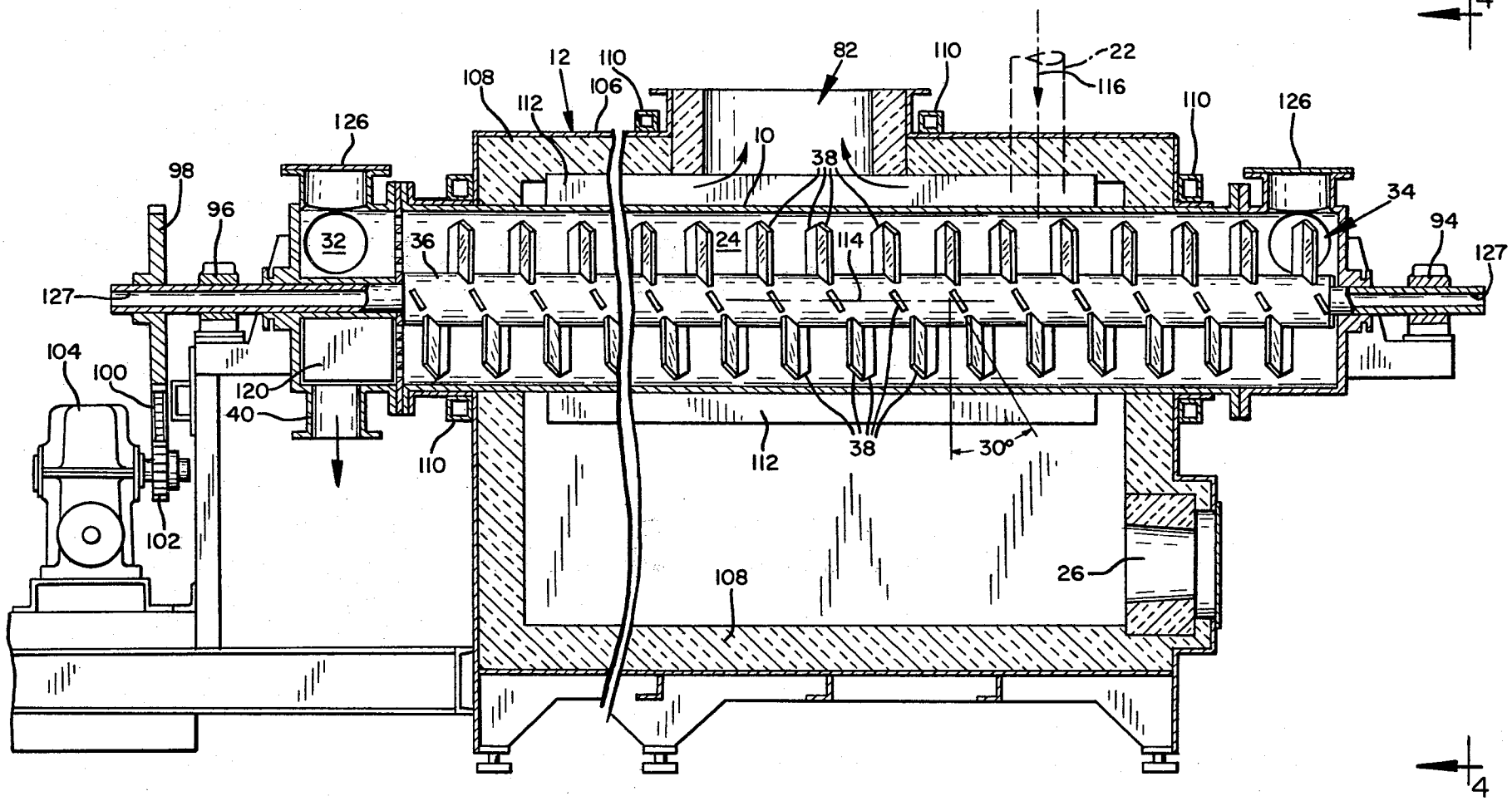
FIG. 3 is a horizontal section view taken along the line 3—3 of FIG. 2.
Figure 4:
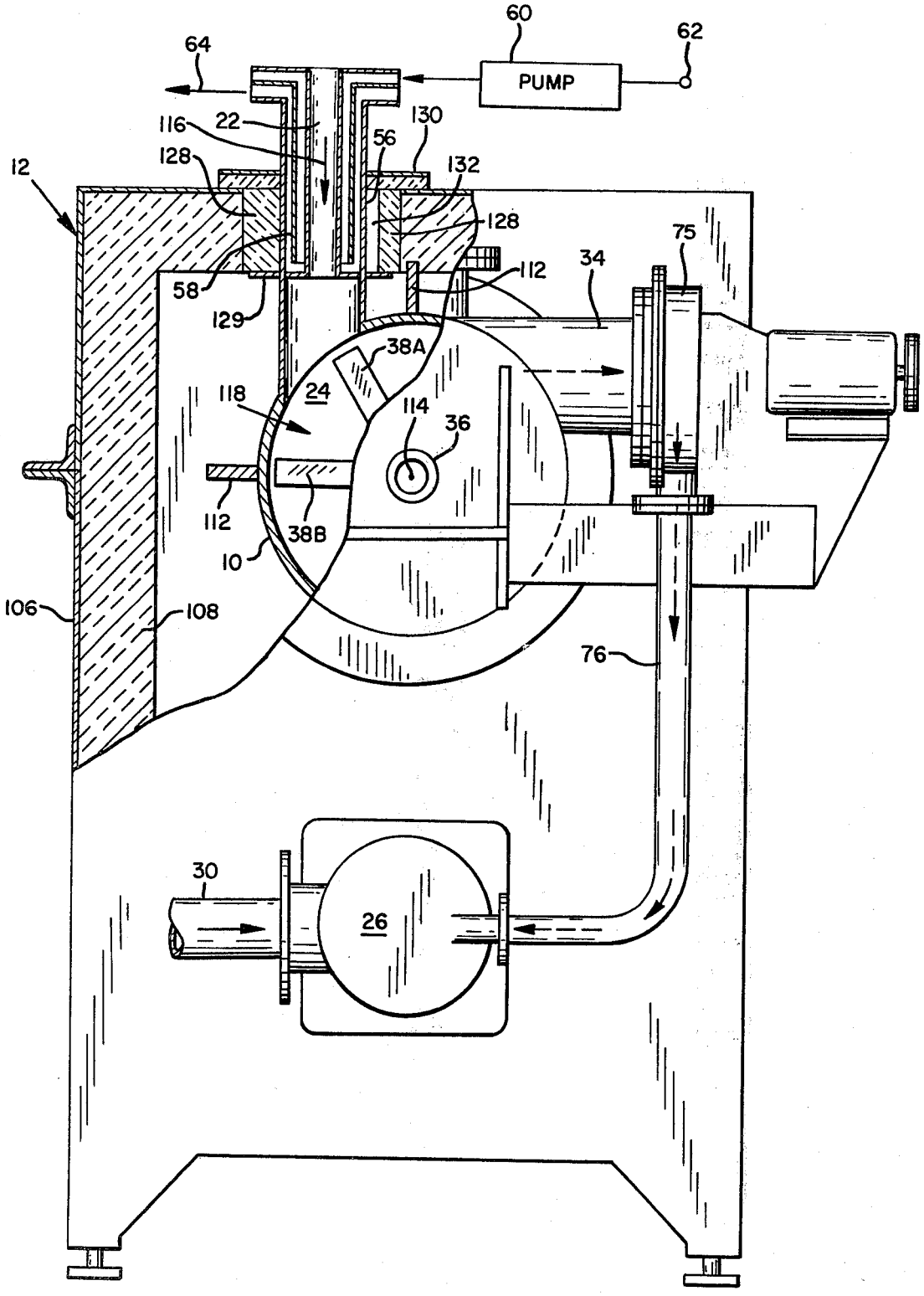
FIG. 4 is an elevation view taken along the line 4—4 of FIG. 3 with parts broken away for clarity.

As shown FIGS. 2 and 3 the furnace 12 includes a metal housing 106 having a lining of ceramic fiber material 108 for heat insulation purposes. A plurality of metal stiffening members 110 are welded to the exterior of the housing for added strength. In addition, longitudinal stiffener plates 112 are welded to the exterior of the metal cylinder 10 forming the reaction chamber. The inlet conduit 22 for feeding carbonizable material into the reaction chamber 10 is positioned so that its axis is laterally spaced about 7 inches from the axis 114 of such reaction chamber which is about 2 feet in diameter and about 13.5 feet long. As a result, the carbonizaable material is fed into the reaction chamber along an input feed path 116 corresponding to the axis of the conduit 22 which is off-center and spaced laterally from the axis 114 of the reaction chamber and impeller shaft. As shown in FIG. 4 the input feed path 116 is directed towards the outer ends of the impeller blades 38, and is spaced from the impeller shaft 36 so that any carbonizable material which melts rather than vaporizes does not fall directly on the impeller shaft and does not cause clogging of the impeller. The tips of the impeller blades 38 terminate closely adjacent to the inner wall of the reaction chamber 10 so that they provide a wiping action to clean such interior surface.

As shown in FIG. 4, the impeller blades are arranged in six groups of aligned blades 38A,38B with the blades of each group being aligned axially along the shaft 36. The groups are spaced 60° apart to provide a space 118 between each adjacent pair of blade groups which enables cleaning of the impeller shaft 36 and the blades by passing a reamer down the axis of the shaft through the input end of the reaction chamber 10 at the right side of FIG. 3. The impeller blades 38 have their flat sides inclined at an angle of approximately 30° with respect to a perpendicular to the axis 114 of the impeller shaft as shown in FIG. 3. This angle of inclination gives a fast feeding action to the auger conveyor formed by such impeller means for feeding the carbonizable material and solid residue through the reaction chamber.

The left end of impeller shaft 36 is also connected to a scrapper blade 120 shown in FIG. 3 for rotation therewith to clean the inlet openings of the solid residue discharge conduit 40 and the first gas outlet conduit 32. A clean-out chamber 122 is provided within the first outlet housing opposite from the first gas outlet 32 to enable cleaning of such gas outlet as shown in FIG. 2. A similar clean-out chamber 124 is provided within the second outlet housing opposite the second gas outlet 34 at the input end of the reaction chamber. These clean-out chambers are normally closed by a cover plate which is bolted in place. A similar cover plate 126 is provided at the top of each of the outlet housing for additional clean out and inspection purposes.

The impeller shaft 36 may be hollow to reduce weight and to enable one or more thermocouples to be moved along a passage 127 through the shaft from one end to the other to measure the temperature within the impeller shaft. In addition, cooling fluid such as cold air or water can be circulated through the impeller shaft for cooling purposes. However, too much cooling is undesirable because it can cause condensation and deposit of the material being treated onto the shaft and impeller blades, thereby causing clogging. Therefore, it is preferable not to use cooling fluid inside the impeller shaft if possible.

As shown in FIG. 4 the cooling jacket 56 surrounding the inlet conduit 22 is welded to the reaction chamber 10 around the inlet opening of such reaction chamber, and is preferably made of the same high-temperature alloy as the reaction chamber. In order to compensate for thermal expansion and other movement the jacket 56 extends through an oversized opening in the wall of the furnace housing 106. Such opening is filled with a sleeve 128 of ceramic fiber which is clamped between an external flange 129 on the outside of the jacket and a metal cap 130 covering the opening in such furnace wall. An expansion space 132 is provided between the cooling jacket 56 and the ceramic fiber sleeve 128 to enable expansion and other movement of the inlet conduit and cooling sleeve relative to the furnace wall.

As described earlier, the cooling jacket 56 is provided with an internal divider sleeve 58 which divides the jacket into an inner chamber between such sleeve and the outer surface of the inlet conduit 22, and an outlet chamber between such sleeve and the surrounding jacket 56. Cooling water circulates from pump 60 through the inner chamber and then the outer chamber before being discharged from oulet pipe 64. This cooling maintains the temperture within the inlet conduit 22 at about 200° F. which is much below the melting temperature of the carbonizable material being fed through such conduit. It is also below the 212° F. boiling temperature of water so that no steam is generated which might create undue pressure in the inlet conduit cooling system. However, the temperature within the reaction chamber 10 at the inlet portion 24 of such reaction chamber immediately below the inlet conduit 22 is maintained at about 1400° F. which is above the vaporization temperature of the carbonizable material in the range of 750° to 780° F. for photographic film particles.

A slight vacuum pressure is maintained within the reaction chamber 10 on the order of −1 to −2 inches of water column pressure. This slight vacuum pressure is maintained by the fan 75 connected to the second gas outlet conduit 34, or by the fan 71 connected to the first gas conduit 32 at the outlet of the gas and liquid recovery system 70. The purpose of the vacuum pressure within the reaction chamber is to prevent the hydrocarbon gas produced by the pyrolysis reaction from leaking out of the chamber into the atmosphere through seals causing air pollution. However, the vacuum pressure cannot be high because this would cause the air containing oxygen to be sucked into the reaction chamber which could cause an explosion.

It will be obvious to those skilled in the art that many changes can be made in the above-described embodiment without departing from the invention. Therefore, the scope of the invention should be determined by the following claims.

I claim:

1. Pyrolysis reaction apparatus, comprising:

a pyrolysis reaction chamber for the pyrolytic decomposition of material by heat in the absence of oxygen;

furnace means including a furnace wall surrounding the reaction chamber, for applying heat to said reaction chamber;

input means for feeding the material to be treated into said reaction chamber while excluding the entry of oxygen containing gas, downward through an inlet conduit extending substantially vertical through the furnace wall along an input feed path to an inlet region within the reaction chamber where the temperature is above the vaporization temperature of said material;

cooling means for cooling the inlet conduit to prevent said material from melting within said inlet conduit sufficiently to cause clogging, said cooling means including a cooling jacket surrounding said inlet conduit and means for flowing cooling fluid through said jacket;

impeller conveyor means rotating about an axis of rotation for conveying said material through said reaction chamber along its longitudinal axis to cause said material to decompose, said input feed path being horizontally spaced from said axis of rotation; and output means for transmitting the residue of the decomposition of said material from said reaction chamber while excluding the entry of oxygen containing gas, through at least one output conduit.

2. Apparatus in accordance with claim 1 in which the output means includes a pyrolysis gas outlet conduit and which includes a burner means for burning combustion gas within said furnace means, said burner means being connected to said gas outlet conduit for burning said pyrolysis gas to heat said reaction chamber.

3. Apparatus in accordance with claim 1 which also includes automatic reamer means for reaming said inlet conduit to prevent clogging.

4. Apparatus in accordance with claim 1 in which the input means feeds the material into the reaction chamber along the input feed path which is off-center spaced horizontally from the longitudinal axis of the reaction chamber.

5. Apparatus in accordance with claim 4 in which the conveyor means is an impeller means having impeller blades attached to a rotating shaft to extend radially outward therefrom for conveying the material through the reaction chamber, and the input feed path is radially spaced from the shaft and directed toward the tips of the blades at the input end of said impeller means.

6. Apparatus in accordance with claim 5 in which the impeller means is an auger and the impeller blades are attached to the shaft along a spiral path, said blades having their width extending at an angle of about 30° to the axis of said shaft.

7. Apparatus in accordance with claim 5 in which the impeller blades are aligned into groups of blades, said groups being spaced about the circumference of said shaft to enable a reamer to extend through the spaces between blade groups for cleaning the impeller means.

8. Apparatus in accordance with claim 1 in which the furnace means includes a combustion gas burner means which is located adjacent the input end of the reaction chamber to cause combustion product gases to flow through the furnace means in the same direction as the flow of said material along said reaction chamber.

9. Apparatus in accordance with claim 8 in which the burner means extends through the end of the furnace means below the reaction chamber and said inlet conduit extends through the top of said furnace means above said reaction chamber so that said inlet conduit is separated from said burner means by said reaction chamber.

10. Apparatus in accordance with claim 1 in which the input means is a means for feeding particles of photographic film into the reaction chamber as the material is being treated.

* * * * *